United States Patent [19]

Yanai et al.

[11] Patent Number: 4,725,500

[45] Date of Patent: Feb. 16, 1988

[54] SIZING COMPOSITIONS AND YARNS SIZED THEREWITH

[75] Inventors: Kiyoshi Yanai; Yoshiro Nakajima, both of Kyoto, Japan

[73] Assignee: Goo Chemical Industries Co., Ltd.

[21] Appl. No.: 843,550

[22] Filed: Mar. 25, 1986

Related U.S. Application Data

[63] Continuation-in-part of Ser. No. 606,070, May 1, 1984, abandoned.

[30] Foreign Application Priority Data

Jul. 25, 1983 [JP] Japan ..... 58-136615

[51] Int. Cl.[4] ..... B32B 27/02; B32B 27/36; C08K 5/04

[52] U.S. Cl. ..... 428/365; 428/394; 428/395; 524/276; 524/513; 525/10; 525/20; 525/23; 525/445; 528/274; 528/286

[58] Field of Search ..... 524/276, 475, 487, 489, 524/513; 528/286, 274; 428/394, 395, 365; 525/10, 445, 20, 23

[56] References Cited

U.S. PATENT DOCUMENTS

| | | | |
|---|---|---|---|
| 4,060,657 | 11/1977 | Iwami et al. | 428/394 X |
| 4,136,069 | 1/1979 | Vachon et al. | 524/489 X |
| 4,316,929 | 2/1982 | McIntire et al. | 428/394 X |
| 4,328,059 | 5/1982 | Horlbeck et al. | 528/286 X |
| 4,394,475 | 7/1983 | Temple et al. | 524/276 X |
| 4,401,782 | 8/1983 | Conklin et al. | 524/489 X |
| 4,477,525 | 10/1984 | Login | 428/394 X |

FOREIGN PATENT DOCUMENTS

| | | | |
|---|---|---|---|
| 0142655 | 11/1975 | Japan | 524/513 |

*Primary Examiner*—Joseph L. Schofer
*Assistant Examiner*—F. M. Teskin
*Attorney, Agent, or Firm*—William A. Drucker

[57] ABSTRACT

Aqueous sizing compositions comprising from 25 to 75 percent by weight of (A) a water-soluble acrylic sizing agent modified with a water-soluble saturated polyester resin and from 75 to 25 percent by weight of (B) a wax emulsion, and yarns sized with the compositions.

2 Claims, No Drawings

SIZING COMPOSITIONS AND YARNS SIZED THEREWITH

REFERENCE TO PRIOR APPLICATION

This appliction is a continuation-in-part of Ser. No. 606,070, filed May 1, 1984, now abandoned.

BACKGROUND OF THE INVENTION

This invention relates to aqueous sizing compositions for use in producing sized yarns and also to yarns sized therewith. It particularly relates to water-soluble sizing compositions which permit energy saving and promotion of efficiency in the manufacture of sized yarns without the need of intentional drying in a chamber or by a cylinder, and to yarns sized with such compositions wherein all of such compositions are provided as aqueous solutions or dispersions and applied to yarns from aqueous systems.

DESCRIPTION OF THE PRIOR ART

Since the birth of the textile industry, most fabrics have been woven by the travel of shuttles under the impact of picking sticks. The conventional weaving methods have drawbacks in that the adoption of faster looms have seriously increased the noise and vibration attendant on the use of shuttles and mechanically their weaving efficiencies have reached the uppermost limits.

In an effort to overcome these drawbacks, development of shuttleless looms has recently been under way. Of these innovations, water and air jet looms that propel the weft through the shed by a jet of water or air have attracted increasing attention. Sized warp yarns for these looms are made selectively by roller sizing, whole or partial sizing or other technique depending on the demand of the market for the products. Whatever the technique employed, the necessity of a process step for drying the yarns limits the speedup or the sizing operation. Drying is the most energy-consuming of the steps for the production of sized yarns and is the factor predominantly responsible for the high cost of the process. Thus the drying step is the tightest bottleneck for the rationalization of the sizing process.

With the view to cutting the cost and enhancing the efficiency through the elimination of the drying step, yarn manufacturers have attempted to produce air-interlaced yarns, warp them by direct warpers, and weave the yarns into fabrics on water jet looms without any sizing agent or by adding an oiling agent. However, increased loom speeds have caused premature wear of reeds and also pilling due to high density weaving, resulting in low weaving efficiencies. For these and othet reasons. only ordinary grade (low density, low count) yarns can be woven in this way into fabrics; special or high quality fabrics of high density, high count, or modified cross-section yarns or the like cannot be woven without sizes. The latter still depend on sized yarns for their construction.

In customary procedures of preparation for weaving, warp yarns are sized, in skeins or not, by roller, beam, or warper sizing machines to impart cohesion and collectability to the yarns. In any case, a sizing or starch solution is prepared, yarns are dipped in a bath of the solution or are coated with it on a rotating drum, the coated yarns are dehydrated in a drying chamber or with hot air, and then the sized yarns thus obtained are used as warps in weaving fabric on a water or air jet loom or other modern weaving machines. The conventional methods necessitate such large energy consumption for the drying step as already noted that there has bean strong need for sizing methods which do not involve any drying operation.

Efforts have hitherto been made to meet this requirement by introducing methods which depend primarily on oiling agents for smoothening of yarns. Exemplary methods are the so-called dry sizing method which uses a solution of a sizing agent in an organic solvent, a method of weaving fabrics or yarns coated only with a wax emulsion (Japanese Pat. No. 828910), and a method of coating yarns, by a warper, with a composition based on a system of a mineral oil, fatty acid ester and nonionic surfactant, with the addition of a phosphate or phosphite ester and diorganopolysiloxane (Japanese Patent Laid-Open No. 137096/1977). The dry sizing method permits slightly faster drying than the ordinary sizing methods but can not totally dispense with a drying step. It simply requires a somewhat less drying capacity than heretofore. On the other hand, it causes spatter of the organic solvent to contaminate the working environment, and the use of the expensive solvent contributes nothing to the economy at which the method is originally aimed. The method of relying upon an oiling agent does improve the smoothness of the finished yarns but fails to impart adequate collectability to the yarns, again rendering it impossible to attain the end desired.

BRIEF SUMMARY OF THE INVENTION

It is an object of this invention to provide water-soluble sizing compositions which make intentional drying unnecessary in the manufacture of sized yarns and also to provide yarns sized with the compositions.

Another object of the invention is to provide water-soluble sizing compositions which permit energy saving, process simplification, and high-speed sizing through omission of the drying step in the manufacture of sized yarns and also to provide yarns sized therewith.

Still another object of the invention is to provide water-soluble sizing compositions for yarns suited for weaving on innovative looms, such as water and air jet looms, and yarns sized therewith wherein all of such compositions are provided as aqueous solutions or dispersions and applied to yarns from aqueous systems.

In order to realize these objects, an aqueous sizing composition is adopted in accordance with the invention which comprises 25 to 75 percent by weight of (A) a water-soluble saturated polyester resin and from 75 to 25 percent by weight of (B) a wax emulsion, and which is diluted with water. The component (A) is obtained by adding from 20 to 0.1 percent by weight of a water-soluble saturated polyester resin containing no unsaturated polyesters prepared by reacting at least one composition selected from the group consisting of dicarboxylic acids, their corresponding acid anhydrides, acid esters, and acid chlorides alone or together with an hydroxy acid having one hydroxyl and one carboxyl group with a diol containing polyethylene glycol as an essential ingredient, none of said acid and diol components being unsaturated, in the presence of an esterifying catalyst and then neutralizing the reaction product with at least one member selected from alkali metal hydroxides, ammonia water, and alkanolamines, to from 80 to 99.9 percent by weight of a monomeric mixture consisting of from 75 to 92 percent by weight of an acrylate and/or a methacrylate of an aliphatioc alcohol having 1 to 24 carbon atoms and from 25 to 8 percent by weight of acrylic acid and/or methacrylic acid; subjecting the mixture of said polyester resin and acrylic monomers to solution polymerization in an aliphatic alcohol having 1 to 3 carbon atoms as a solvent or in such an alcohol and water as a mixed solvent; and then neutralizing the resulting polyumer with at least one member selected from alkali metal hydroxides, ammonia water, and alkanolamines. The component (B) is obtained from among natural waxes and/or synthetic waxes having melting points of above 50° C. and saponification values ranging from 10 to 200.

The above and other objects, features, and advantages of the invention will become more apparent from a reading of the following detailed description.

DETAILED DESCRIPTION OF THE INVENTION

An intensive study has been carried out on the manner of sizing by which the drying step that calls for tremendous power consumption can be omitted and the process is simplified. An initial attempt was to dissolve a conventionally employed acrylic sizing agent in water, size yarn with the aqueous solution by a direct warper, take up the sized yarn on a beam without drying, and weave it into fabric. The attempt failed because the yarn was seized in the beam in the rewinding step to make weaving impossible. This was thought ascribable to inadequate separation of sized yarns. As a next attempt therefore a so-called oiling agent or a known composition, consisting of 3 mineral oil, fatty acid, ester, higher alcohol, and nonionic surfactant was used together with the acrylic sizing agent. With this exception, the yarn was sized for weaving the same way as above. The oiling agent plasticized the film of the sizing agent, and severe gumming or the reed and healds caused heddle choking, which in turn made weaving impossible.

A known water-soluble polyester resin was used to size yarn for weaving on a water jet loom. However, weaving was hampered by yarn-to-yarn sticking in the beam.

In a further attempt, yarn was sized with a sizing solution consisting or 50 percent by weight each of the known water-soluble polyester resin and a wax emulsion and the sized yarn was wound on a beam for weaving. It could be somehow or other woven into fabric, but the grey fabric so obtained was poorly scourable and the sizing solution was disappointingly instable. Ordinarily, water-soluble polyester resins, available as aqueous solutions, lack chemical stability. While the resins are in storage, hydrolysis or the ester group results in scission or the molecular chain, and such resins inevitably have a shortcoming or performing differently with each service or application. Especially when stored in the form of aqueous solutions, they prove far less stable than water-soluble acrylic ester resins. In addition, the water-soluble polyester resins, which coagulate in aqueous solutions of strong alkalis will make continuous scouring infeasible where caustic soda is employed.

Further experiments showed that the foregoing problems are settled and good scouring is obtained by neutralizing the water-soluble polyester resin with an esterified phosphoric acid compound or methanesulfonic acid as a means for water-solubilizing the resin satisfactorily. Then, attempts were made to mix the water-soluble polyester resin with water-soluble sizing agents based on acrylic esters. Mixtures in varied proportions were tested for stability in a thermostat at 40° C. Whatever the proportion, they precipitated into two separate layers within 72 hours. At room temperatures they separated into two layers within two weeks. It was found, after all, that mere mixing of the two does not solve the above problems.

Studies were then concentrated on development of a sizing agent which would combine the long-period stability of the water-soluble acrylic sizing agent in aqueous solutions thereof with the adhesiveness of the water-soluble polyester resin. As a result, a water-soluble acrylic sizing agent (A) modified with a water-soluble saturated polyester resin was obtained. The component (A) is obtained by adding from 20 to 0.1 percent by weight of a water-soluble saturated polyester resin containing no unsaturated polyesters, prepared by reacting at least one composition selected from the group consisting of dicarboxylic acids, their corresponding acid anhydrides, acid esters, and acid chlorides alone or together with an hydroxy acid having one hydroxyl and one carboxyl group with a diol containing polyethylene glycol as an essential ingredient, none of said acid and diol components being unsaturated, by the addition of at least one esterifying catalyst selected from the group consisting of phosphoric, pyrophosphoric, polyphosphoric, phosphorous, and methanesulfonic acids, and then neutralizing the reaction product with at least one member selected from alkali metal hydroxides, ammonia water, and alkanolamines, to from 80 to 99.9 percent by weight of a monomeric mixture consisting of from 75 to 92 percent by weight of an acrylate and/or a methacrylate of an aliphatic alcohol having 1 to 24 carbon atoms and from 25 to 8 percent by weight of acrylic acid and/or methacrylate acid; subjecting the mixture of said polyester resin and acrylic monomers to solution polymerization in an aliphatic alcohol having 1 to 3 carbon atoms as a solvent or in such an alcohol and water as a mixed solvent; and then neutralizing the resulting polymers with at least one selected from alkali metal hydroxides, ammonia water, and alkanolamines. The water-soluble acrylic sizing agent (A) thus modified is excellently adhesive as compared with the ordinary water-soluble sizing agents of acrylic esters. Moreover, this sizing agent remained stable without any precipitation when allowed to stand in a thermostat at 40° C. for six months, and was stable at room temperatures for over one year.

It has now been found that the objects of the invention are achieved by the provision of a sizing composition comprising from 25 to 75 percent by weight of such a modified, water-soluble acrylic sizing agent (A) and a wax emulsion (B) consisting of natural waxes and/or synthetic waxes having melting points of above 50° C. and saponification values ranging from 10 to 200. The discovery has led to the perfection of the present invention. The use of the sizing compositions according to the invention solves all of the problems that would arise from the elimination of the drying step, for example, beam choking caused by yarn-to-yarn adhesion due to winding of the wet sized yarn on the beam, inadequate shedding during weaving operation, poor cohesion, size deposition on the reed, healds, and back rollers, and reduction in the overall rate of operation even though such compositions are applied to yarns from aqueous systems as well as other conventional sizing compositions. Omission of the drying step has now actually become feasible.

In the present invention, useful acrylates and methacrylates of aliphatic alcohols having 1 to 24 carbon atoms include those of methyl, ethyl, propyl, isopropyl, butyl, isobutyl, tert-butyl, octyl, 2-ethylhexyl, lauryl, myristyl, cetyl, stearyl and arachidic alcohols and tetracosanol. There is no limitation to the copolymerization of such monomers with other copolymerizable monomers, such as vinyl acetate, vinyl propionate, styrene, acrylamide, methacrylamide, diacetone acrylamide, acrylonitrile, methacrylonitrile and cyclohexyl methacrylate.

The dicarboxylic acid for use in preparing the water-soluble saturated polyester resin in accordance with the present invention may be a saturated aliphatic, alicyclic, or aromatic one. Examples of such dicarboxylic acids are oxalic, malonic, dimethylmalonic, succinic, glutaric, adipic, pimelic, acelaic, sebacic, phthalic, terephthalic and isophthalic acids. In addition, the usable compounds include saturated acid anhydrides, esters and acid chlorides corresponding to the above mentioned acids. The hydroxy acid may be a saturated aliphatic or aromatic one. Among such acids are m-,p-hydroxybenzoic, glycolic, lactic, hydroxyacrylic, salicylic, mandelic, and tropic acids, and also $\beta$-hydroxyethyl terephthalate.

The diol which is saturated, to be used in the invention, contains polyethylene glycol as an essential ingredient and may be optionally combined with an aliphatic, alicyclic, or aromatic diol. Examples of such optionally selectable diols are polypropylene glycol, ethylene glycol, propylene glycol, 1,3-propanediol, 1,3-butanediol, 1,4-butanediol, 1,5-pentanediol, 1,6-hexanediol, 4,4'-methylenediphenol, 2,5-naphthalenediol and ethylene carbonate.

The water-soluble saturated polyester resin for use in the present invention is obtained by mixing at least one composition selected from the group consisting of dicarboxylic acids, their corresponding acid anhydrides, acid esters, and acid chloides alone or together with the hydroxy acid with the diol, and allowing the mixture to react in the presence of at least one esterifying catalyst selected from the group consisting of phosphoric, pyrophosphoric, polyphosphoric, phosphorous and methanesulfonic acids under ordinary or reduced pressure at 200° to 300° C., and then neutralizing the reaction product.

Copolycondensation of the resin with sodium 5-sulfoisophthalate or such like monomer is possible, although it can adversely affect the scourability of the resulting grey fabric.

The mixing ratio of the acrylate monomers and the water-soluble saturated polyester resin is, as specified above, 80–99.9:20–0.1 (percent by weight). If the proportion of the water-soluble saturated polyester resin exceeds 20 percent by weight, the polymerization reaction will scarcely take place, with a consequent drop in the rate of polymerization. If the percentage is less than 0.1, the beneficial effect of the resin addition will not be fully achieved.

Useful wax emulsions for the present invention include those of natural waxes, such as carnauba, candelilla, bees, Japan, montan, and rice-bran waxes, and of synthetic waxes, such as polyethylene oxide wax, oxidized wax, sorbitol, pentaerythritol, glycerin, and the waxes obtained by esterification of ethylene glycol with fatty acids having 14 to 24 carbon atoms. For the emulsification of these waxes ordinary nonionic and anionic surfactants may be used.

The mixing ratio of the water-soluble acrylic sizing agent (A) modified with a water-soluble saturated polyester resin containing no unsaturated polyesters to the wax emulsion (B) is, as already specified, in the range of 25–75:75–25 (percent by weight). If the proportion of the sizing agent (A) exceeds 75 percent by weight, the yarn-separating effect inherent to the wax will not be fully attained. Conversely if the proportion is less than 25 percent by weight, the cohesion of the sized yarn will not be sufficient.

With sizes in common use the sizing speeds have usually been confined within the range of 80 to 130 meters per minute. This is because the yarn speed should be low enough for drying the sized yarn. The sizing composition according to the present invention, which dispenses with the step for drying, can be adequately applied to yarn by a sizing roller simply attached to a direct warper. The sizing speed can be raised to the maximum capacity of the machine of as high as 400 to 500 m/min.

In order to illustrate the advantageous effects of the present invention, a sizing composition according to the invention was tested for sizing and weaving, along with a conventional sizing agent and a straight oiling agent applied to material yarn for non-sized use.

The results are compared in Table 1.

Kind of fabric: Crepe de chine

Material yarn: Polyester filament yarn SD 50D-24F

Loom: Water jet loom, Model (Nissan LW-41", manufactured by Nissan Motor Co. of Japan Loom speed: 450 rpm Test specimens:

A. Sizing composition of the invention

Material yarn—sizing by a high-speed warper, Model Tsudakoma Warper TW-N", mfd. by Tsudakoma Industrial Co. of Japan—beaming.

COMPOSITION (a) monomers, 100 parts by weight

| | |
|---|---|
| Ethyl acrylate | 20 wt % |
| Butyl acrylate | 30 wt % |
| Methyl methacrylate | 25 wt % |
| Lauryl methacrylate | 13 wt % |
| Acrylic acid | 7 wt % |
| Methacrylic acid | 5 wt % |

(b) Water-soluble polyester resin, 8 parts by weight

| | |
|---|---|
| Terephthalic acid | 50 wt pts |
| Isophthalic acid | 25 wt pts |
| Polyoxyethylene glycol (mol.wt. 600) | 50 wt pts |
| Ethylene glycol | 55 wt pts |
| Phosphorous acid | 8 wt pts |
| 10% ammonia water | 20 wt pts |

(c) Wax emulsion, 40 parts by weight

| | |
|---|---|
| Carnauba wax | 40 wt pts |
| Candelilla wax | 30 wt pts |
| Montan wax | 5 wt pts |
| Polyoxyethylene lauryl ether (20 mol ethylene oxide added) | 10 wt pts |
| Polyoxyethylene oleyl ether (14 mol EO added) | 10 wt pts |
| Sorbitan monooleate | 5 wt pts |

B. Conventional sizing agent

"PLAS-SIZE J-6" (trade name of an acrylic sizing agent for water jet looms marketed by Goo Chemical Industry Co. of Japan)

Material yarn—sizing by a warper sizing machine, "Kawamoto Warper Sizing Machine Model EX" mfd. by Kawamoto Seiki Co. or Japan—beaming.

C. Straight oiling agent

"SYETEX S-571" (trade name or a straight oiling agent or mineral type marketed by Goo Chemical)

Material yarn—oiling by a high speed warper "Tsudakoma Warper Model TW-N" mfd. by Tsudakoma Industrial—beaming.

TABLE 1

(No. of fabric pieces, each about 50 m long, tested: 100 pieces each)

| Type of machine used | A High-speed warper | B Warper sizing | C High-speed warper |
|---|---|---|---|
| Kind of sizing or oiling agent | Sizing compn of invention | "PLAS-SIZE J-6" | "SYETEX S-571" |
| Yarn speed (m/min) | 400 | 100 | 400 |
| Coverage (%) | 4.5 | 5.1 | 3.0 |
| Tension: Creel (g) | 3.5 | 6.0 | 3.5 |
| Winding (g) | 3.5 | 18.0 | 3.5 |
| No. 1 chamber temp (°C.) | — | 110 | — |
| No. 2 chamber temp (°C.) | — | 120 | — |
| No. 1 cylinder temp (°C.) | — | 105 | — |
| No. 2 cylinder temp (°C.) | — | 90 | — |
| Fuel oil consumption (l/100 pieces) | — | 135 | — |
| Electric power consumption (kWh) | 2.0 | 15 | 2.5 |
| Electric power consumption rate (kW/kg) | 0.02 | 0.42 | 0.02 |
| Weaving efficiency (%) | 95.2 | 94.1 | Unweavable |
| Good rate (%) | 98.0 | 97.0 | — |

As will be obvious from Table 1, the sizing composition of the invention eliminates the need of thermal energy for drying, reduces the electric power consumption during sizing to 1/21 of that with the conventional sizing agent, and yet improves the weaving efficiency and goods rate over the conventional processes. When the oiling agent "SYETEX S-571" for material yarn to be woven without sizing was applied to the yarn to be sized, too much pilling made weaving impossible.

To further illustrate the present invention, the following examples are presented which are intended for a better understanding or the invention and are not to be construed to limit the scope thereof. Throughout the examples, quantities expressed in percentages and parts are all by weight.

EXAMPLE 1

Starting materials, namely,

| | |
|---|---|
| terephthalic acid | 75 parts |
| p-hydroxybenzoic acid | 40 parts |
| polyoxyethylene glycol (molecular weight 2000) | 60 parts |
| ethylene glycol | 80 parts |
| phosphorous acid | 5 parts |

were charged into a four-necked, one-liter flask having a gas inlet and equipped with a thermometer, condenser, and stirrer. The charge was gradually heated while sparging with nitrogen and was allowed to react at 240° to 250° C. for 4 to 5 hours until 60 parts or distillate was obtained. The acid value of the distillate was 50.

It was neutralized with 19 parts of ammonia water diluted to 10 percent, and water was added to prepare a 20% aqueous solution for use as a water-soluble polyester resin A.

Using this polyester resin A, an acrylic ester sizing agent was modified.

A mixture consisting of

| | |
|---|---|
| butyl acrylate | 45 parts |
| methyl methacrylate | 25 parts |
| stearyl methacrylate | 15 parts |
| acrylic acid | 10 parts |
| methacrylic acid | 5 parts |
| water-soluble polyester resin A | 20 parts |

was solution-polymerized in 100 parts or ethyl alcohol, with the addition or 2 parts or benzoyl peroxide as a polymerization catalyst, under reflux at 78° to 80° C.

Four hours after the initiation of the polymerization, the reaction was concluded and the product was neutralized with 40 parts or 10% ammonia water. With the addition or diluting water, a modified water-soluble acrylic resin A in a concentration or 20 percent was obtained.

A wax composition consisting of

| | |
|---|---|
| carnauba wax | 50 parts |
| montan fatty acid | 30 parts |
| Japan wax | 20 parts |

was melted and emulsified with 30 parts or polyoxyethylene lauryl ether (with 20 mol or ethylene oxide added) as an emulsifier at 80° to 85° C. With the addition of water, a wax emulsion A having a concentration of 20 percent was obtained.

One hundred parts of the modified water-soluble acrylic resin A was mixed with 50 parts or the wax emulsion A to prepare a sizing composition A of the invention.

Blended polyester yarn or differently shrinkable fibers, 50 deniers by 36 filaments and twisted at 300 T/m, was sized with this sizing composition A on a slasher-sizing machine without thermal drying but with a mere jet or air. The coverage or amount of addition was 4.0 percent.

Using this yarn as the warp, satin with a density or 198×99/in. was woven (by a water jet loom "Nissan LW 41" at a speed or 450 rpm). The results were favorable with a weaving efficiency or 95 percent and goods rate or 98 percent.

EXAMPLES 2 to 8

Generally in the same way as described in Example 1, water-soluble polyester resins B to H were prepared for use in Examples 2 to 8. respectively.

| Component (part) | Water-soluble polyester resin B | C | D | E | F | G | H |
|---|---|---|---|---|---|---|---|
| Terephthalic acid | 30 | 20 | 60 | 30 | 60 | — | — |
| Isophthalic acid | — | 60 | — | 20 | 10 | 70 | 50 |
| Phthalic acid | 60 | — | — | — | — | — | — |
| Adipic acid | — | 20 | — | — | 10 | — | 25 |
| Sebacic acid | 10 | — | 20 | 50 | — | 30 | 25 |
| Salicylic acid | — | — | — | — | 20 | — | — |
| Methyl p-hydroxybenzoate | — | — | 15 | — | — | — | — |
| Ethylene glycol | 100 | 100 | 100 | 100 | 100 | 100 | 100 |
| Polyethylene glycol (molecular weight) | 50 (1540) | 30 (1000) | 50 (4000) | 30 (600) | 10 (6000) | 20 (200) | 30 (600) |
| Triethylene glycol | — | 10 | — | — | 20 | — | — |
| Phosphoric acid | 7 | — | — | — | 5 | 7 | 7 |
| Polyphosphoric acid | — | 5 | — | — | 2 | — | — |
| Metaphosphoric acid | — | — | 7 | — | — | — | — |
| Pyrophosphoric acid | — | — | — | 7 | — | — | — |

Using these water soluble polyester resins B to H, the procedure or Example 1 was repeated to prepare modified water-soluble acrylic resins B to H, respectively, for use in Examples 2 to 8.

| Component (part) | Modified water-soluble acrylic resin B | C | D | E | F | G | H |
|---|---|---|---|---|---|---|---|
| Ethyl acrylate | 27 | 44 | — | 13 | 30 | — | 12 |
| Butyl acrylate | 30 | — | 38 | 40 | 12 | 41 | 30 |
| Butyl methacrylate | — | — | — | 15 | — | — | 5 |
| 2-Ethylhexyl methacrylate | 10 | — | 5 | — | 5 | 5 | — |
| Isopropyl methacrylate | — | 10 | 5 | — | 5 | — | — |
| Methyl methacrylate | 25 | 30 | 33 | 20 | 28 | 40 | 35 |
| Myricyl methacrylate | — | — | — | 10 | — | — | — |
| Acrylic acid | 8 | 6 | 9 | 5 | 15 | 12 | 15 |
| Methacrylic acid | 4 | 10 | 10 | 7 | 5 | 2 | 3 |
| Water-soluble polyester resin (Kind) | 3 (B) | 5 (C) | 10 (D) | 20 (E) | 30 (F) | 50 (G) | 80 (H) |

Also, in the same manner as in Example 1, wax emulsions B to D were prepared for use in Examples 2 to 8.

| Material composition of the wax emulsion B | |
|---|---|
| Beeswax | 30 parts |
| Candelilla wax | 15 parts |
| Oxidized wax | 30 parts |
| Hardened tallow oil | 25 parts |
| Polyoxyethylene lauryl ether (with 15 mol of ethylene oxide added) | 30 parts |
| **Material composition of the wax emulsion C** | |
| Japan wax | 55 parts |
| Sorbitan monostearate | 10 parts |
| Polyethylene oxide | 35 parts |
| Polyoxyethylene cetyl ether (with 10 mol of ethylene oxide added) | 30 parts |
| **Material composition of the wax emulsion D** | |
| Carnauba wax | 25 parts |
| Polyethylene oxide | 45 parts |
| Beeswax | 30 parts |
| Polyoxyethylene lauryl ether (with 20 mol of ethylene oxide added) | 30 parts |

Next. the modified water-soluble acrylic resins B to H and the wax emulsions B to D were mixed in varied proportions to prepare sizing compositions for Examples 2 to 8. Bright polyester yarn or modified cross sections, 50D-36F and twisted at 285 T/m, was sized with these composition in the same way as described in Example 1. The differently sized yarns were woven into palace crepe, 20 pieces each. For the weaving, a water jet loom "Nissan LW-41" was employed.

| Composition (%) | Sizing composition Ex. 2 | Ex. 3 | Ex. 4 | Ex. 5 | Ex. 6 | Ex. 7 | Ex. 8 |
|---|---|---|---|---|---|---|---|
| Modified water-soluble acrylic resin | | | | | | | |
| (20% conc.) | 75 | 70 | 30 | 60 | 70 | 70 | 70 |
| (kind) | (B) | (C) | (D) | (E) | (F) | (G) | (H) |
| Wax emulsion | | | | | | | |
| (20% conc.) | 25 | 30 | 70 | 40 | 30 | 30 | 30 |
| (kind) | (B) | (B) | (B) | (C) | (D) | (D) | (D) |
| Test item | | | | | | | |
| Weaving efficiency (%) | 99 | 97 | 96 | 98 | 98 | 97 | 99 |
| Goods rate (%) | 98 | 97 | 97 | 99 | 96 | 99 | 98 |

As can be seen from the table, the sizing compositions according to Examples 2 to 8 permitted satisfactory weaving without undesirable desizing during operation, thus rendering it possible to achieve high weaving efficiencies and goods rate.

While the invention has been described in its preferred embodiments, it is to be understood that the invention is not limited thereto but may be otherwise variously embodied without departing from the spirit and the scope of the invention as hereinafter claimed.

What is claimed is:

1. An aqueous sizing composition comprising from 25 to 75 percent be weight of (A) a water-soluble sizing agent and from 75 to 25 percent by weight of (B) a wax emulsion, said component (A) being obtained by adding from 20 to 0.1 percent by weight of a water-soluble saturated polyester resin containing no unsaturated polyesters, prepared by reacting at least one composition selected from the group consisting of dicarboxylic acids, their corresponding acid anhydrides, acid esters, and acid chlorides alone or together with an hydroxy acid having one hydroxyl and one carboxyl group with a diol containing polyethylene glycol as an essential ingredient, none of said acid and diol components being unsaturated, in the presence of at least one esterifying catalyst selected from the group consisting of phosphoric, pyrophosphoric, polyphosphoric, phosphorous and methanesulfonic acids, and then neutralizing the reaction product with at least one member selected from alkali metal hydroxides, ammonia water and alkanolamines, to from 80 to 99.9 percent by weight of a monomeric mixture consisting of from 75 to 92 percent by weight of an acrylate and/or a metha-crylate of an aliphatic alcohol having 1 to 24 carbon atoms and from 25 to 8 percent by weight of acrylic acid and/or methacrylic acid; subjecting the mixture of said polyester resin and acrylic monomers to solution polymerization in an aliphatic alcohol having 1 to 3 carbon atoms as a solvent or in such an alcohol and water as a mixed solvent; and then neutralizing the resulting polymer with at least one member selected from alkali metal hydroxides, ammonia water and alkanolamines, said component (B) being obtained by emulsifying at least one composition selected from the group consisting of natural waxes and synthetic waxes, having melting points of above 50° C. and saponification values ranging from 10 to 200.

2. A yarn sized with an aqueous sizing composition comprising from 25 to 75 percent by weight of (A) a water-soluble sizing agent and from 75 to 25 percent by weight of (B) a wax emulsion, said component (A) being obtained by adding from 20 to 0.1 percent by weight of a water-soluble saturated polyester resin containing no unsaturated polyesters, prepared by reacting at least one composition selected from the group consisting of dicarboxylic acids, their corresponding acid anhydrides, acid esters, and acid chlorides alone or together with an hydroxy acid having one hydroxyl and one carboxyl group with a diol containing polyethylene glycol as an essential ingredient, none of said acid and diol components being unsaturated, in the presence of at least one esterifying catalyst selected from the group consisting of phosphoric, pyrophosphoric, polyphosphoric, phosphorous, and methanesulfonic acids, and then neutralizing the reaction product with at least one member selected from alkali metal hydroxides, ammonia water, and alkanolamines, to from 80 to 99.9 percent by weight of a monomeric mixture consisting of from 75 to 92 percent by weight of an acrylate and/or a methacrylate of an aliphatic alcohol having 1 to 24 carbon atoms and from 25 to 8 percent by weight of acrylic acid and/or methacrylic acid; subjecting the mixture of said polyester resin and acrylic monomers to solution polymerization in an aliphatic alcohol having 1 to 3 carbon atoms as a solvent or in such an alcohol and water as a mixed solvent; and then neutralizing the resulting polymer with at least one member selected from alkali metal hydroxides, ammonia water and alkanolamines, said component (B) being obtained by emulsifying at least one composition selected from the group consisting of natural waxes and synthetic waxes, having melting points of above 50° C. and saponification values ranging from 10 to 200.

* * * * *